United States Patent [19]

Bullivant

[11] Patent Number: 4,605,339

[45] Date of Patent: Aug. 12, 1986

[54] SITU PILE CONSTRUCTION IN GROUND LIABLE TO UPLIFT

[75] Inventor: Roger A. Bullivant, Burton-on-Trent, England

[73] Assignee: Roger Bullivant of Texas, Inc., Grand Prairie, Tex.

[21] Appl. No.: 574,564

[22] Filed: Jan. 27, 1984

Related U.S. Application Data

[63] Continuation-in-part of Ser. No. 288,133, Jul. 29, 1981, abandoned.

[51] Int. Cl.[4] ..... E02D 5/34; E02D 5/44

[52] U.S. Cl. ..... 405/237; 405/233

[58] Field of Search ..... 405/231–233, 405/235, 236, 237, 239, 243, 245, 257, 256, 288 (U.S. only), 290; 52/170, 743, 744

[56] References Cited

U.S. PATENT DOCUMENTS

| | | | |
|---|---|---|---|
| 1,449,032 | 3/1923 | Blumenthal | 405/243 |
| 3,113,436 | 12/1963 | Nalen | 405/237 |
| 3,496,729 | 2/1970 | Pleuger | 405/239 X |
| 3,685,302 | 8/1972 | Fuller | 405/239 X |
| 3,805,535 | 4/1974 | Van Week | 405/237 |
| 4,063,423 | 12/1977 | Gurkov et al. | 405/239 |
| 4,070,867 | 1/1978 | Cassidy | 405/231 |
| 4,249,837 | 2/1981 | Spies | 405/290 |

FOREIGN PATENT DOCUMENTS

| | | |
|---|---|---|
| 1392868 | 5/1975 | United Kingdom . |
| 2048999 | 12/1980 | United Kingdom . |
| 2054709 | 2/1981 | United Kingdom . |

*Primary Examiner*—Cornelius J. Husar
*Assistant Examiner*—Nancy J. Stodola
*Attorney, Agent, or Firm*—Richards, Harris, Medlock & Andrews

[57] ABSTRACT

The specification discloses a in situ cased pile and method for constructing same under the footing of a building. The invention is particularly suited to the stabilization of building footings in regions of unstable soil subject to uplift or subsistence. The cased pile extends through the unstable soil to a region of stable soil, and rests thereon. An enlarged pile footing in the stable soil is used. The movement of the unstable soil is isolated from the pile by means of a casing or tubular sleeve which surrounds the casing. A method of forming this structure in situ, without removing the unstable soil, is also disclosed. In the practice of this method a self-propelled soil displacing mole forms a hole in the subsoil and draws down a steel tube (15) to line the hole. The mole is withdrawn, a PVC or cardboard tube (16) is slid down the lined hole, and the lined hole is filled with concrete. The mole is re-run to produce a pile footing (17) and is again withdrawn. The resulting in situ cased pile is thereby isolated from frictional engagement with the subsoil to avoid heave.

13 Claims, 3 Drawing Figures

SITU PILE CONSTRUCTION IN GROUND LIABLE TO UPLIFT

BACKGROUND OF THE INVENTION

This patent application is a continuation-in-part application of U.S. patent application Ser. No. 288,133 filed on July 29, 1981 now abandoned.

This invention relates to the construction of an in situ pile in ground liable to uplift.

My published British Patent Application No. 2048999A, the disclosure of which is incorporated herein by reference, discloses a method for constructing a pile in situ comprising: forming a hole in the subsoil by allowing an elongate self-propelled soil displacing mole to descend through the subsoil; withdrawing the mole; filling the hole with concrete; allowing such mole to descend within the filled hole before the concrete sets to produce a pile footing and to displace concrete into the hole wall; withdrawing such mole; and refilling the hole with concrete and allowing the concrete to set to form an in situ pile with an integral footing.

My published British Patent Application No. 2054709A, the disclosure of which is incorporated herein by reference, further discloses a method of constructing a pile in situ comprising: forming a hole in the subsoil by allowing an elongate self-propelled soil displacing mole to descend through the subsoil; said mole being partially received within and drawing down with itself a tubular member of internal diameter larger than the external diameter of the mole whereby to line the hole; withdrawing the mole up through the bore of the tubular member; filling the lined hole with concrete; allowing such mole to descend within the filled lined hole before the concrete sets to produce a pile footing and to displace concrete from the bottom of the hole up outside the tubular member into the actual hole wall; withdrawing such mole; and refilling the hole with concrete and allowing the concrete to set to form an in situ cased pile with an integral footing.

One advantage of forming the hole by such methods of soil displacements, as opposed to soil removal, is to enhance the skin friction effect so that the pile bears a load by this effect as well as by direct end loading on a firm substratum. However certain subsoil materials are prone to expansion or swelling, for example clay in the presence of moisture. Thus, a stand of mature trees may be felled and new housing built. The tree roots no longer abstract ground water and so the clay absorbs moisture and swells over a period of months or years causing heave or uplift to the foundations of the houses.

Where heave is anticipated one course is to support the footings of the new buildings on piles taken down to the rock or other firm substratum. The footings themselves can be substantially isolated from the effects of heave by resting them on clayboard, e.g., of polystyrene. The end loading of the piles is taken by the substratum, but the remaining problem is the effect of uplift on the piles themselves due to the skin friction effect. This problem is particularly important where the piles are formed in situ holes prepared by soil displacement as discussed above.

An object of the present invention is to provide a method of constructing a pile in situ in which the above described problem of heave or uplift due to the skin friction effect is avoided.

SUMMARY OF THE INVENTION

The present invention relates to a means and method of isolating piles or footings from unstable soil, by creating a footing below the unstable soil, and sleeving the pile.

The particular invention is particularly suited for situations in which it is not practical or feasible to excavate the unstable soil to reach stable soil. The footing may be formed in the stable soil without removing the region of unstable soil.

The invention is also suited to the in situ construction of such a pile or footing under an existing building.

The method of constructing a pile in situ may be summarized as follows:

forming a hole in the subsoil by allowing an elongate self-propelled soil displacing mole to descend through the subsoil; said mole drawing down with itself a first tubular member of internal diameter significantly larger than the external diameter of the mole to line the hole;

withdrawing the mole up through the bore of the first tubular member;

inserting a second tubular member into the first tubular member;

filling the hole within the second tubular member with concrete;

allowing such mole to descend within the filled hole of the second member before the concrete sets to produce a pile footing;

withdrawing such mole; and refilling the hole with concrete and allowing the concrete to set to form an in situ cased pile with an integral footing, whereby to isolate the pile from frictional engagement with the subsoil over at least a portion of its length.

It will be appreciated that the desired isolation is accomplished by a sliding motion of the first, outer tubular member vertically in relation to the second, inner tubular member and the concrete of the pile.

Normally the first and second tubular members would extend over substantially the full length of the pile down to adjacent the integral footing. The first tubular member could be steel and the second could be of polyvinylchloride or of cardboard.

DESCRIPTION OF PREFERRED EMBODIMENT

Figure 1:
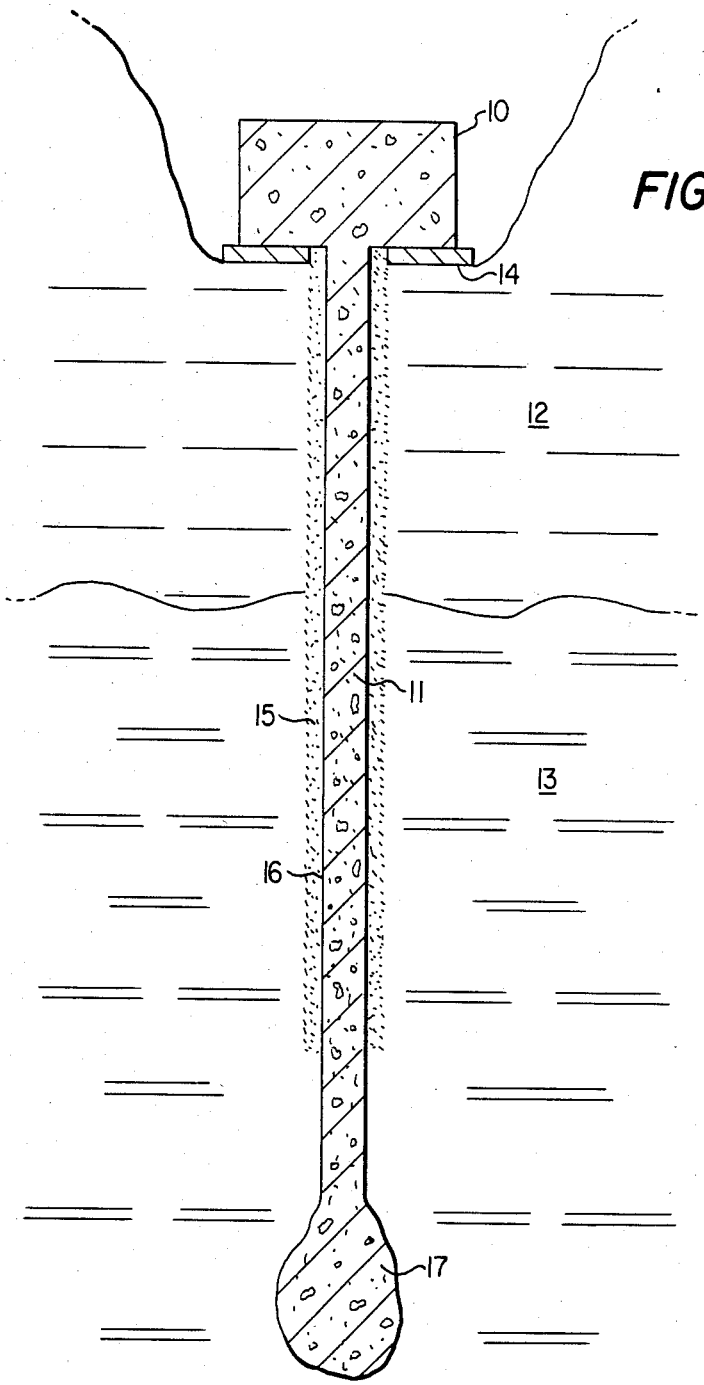
FIG. 1 is a diagrammatic vertical section through a building footing, a pile, a sleeve, a region, of unstable soil and a region of stable soil.

FIG. 1 shows a vertical section through a reinforced concrete footing 10, for a building, supported on a row of piles, one of which is shown at 11. The piles pass through a layer 12 of clay or other expansive unstable subsoil liable to heave, and pass into a layer 13 of rock or other firm stable soil or substratum. The piles 11 may be formed before the footing 10, or preferably the footing is formed first and the pile subsequently. The latter may be accomplished by setting expanded metal sleeves at the desired pile head locations and tying them into the reinforcing members laid for the footing 10. The concrete is then poured around the sleeves to form the footing 10, the concrete extruding itself slightly through the expanded metal to give a roughened hole. When the concrete has gained strength the piles are formed in situ working down through the sleeves. The roughened interior of the sleeve holes binds the piles to the footing 10. In either order, the footings are formed on top of clayboard 14 to absorb any heave in subsoil layer 12.

Figure 2:
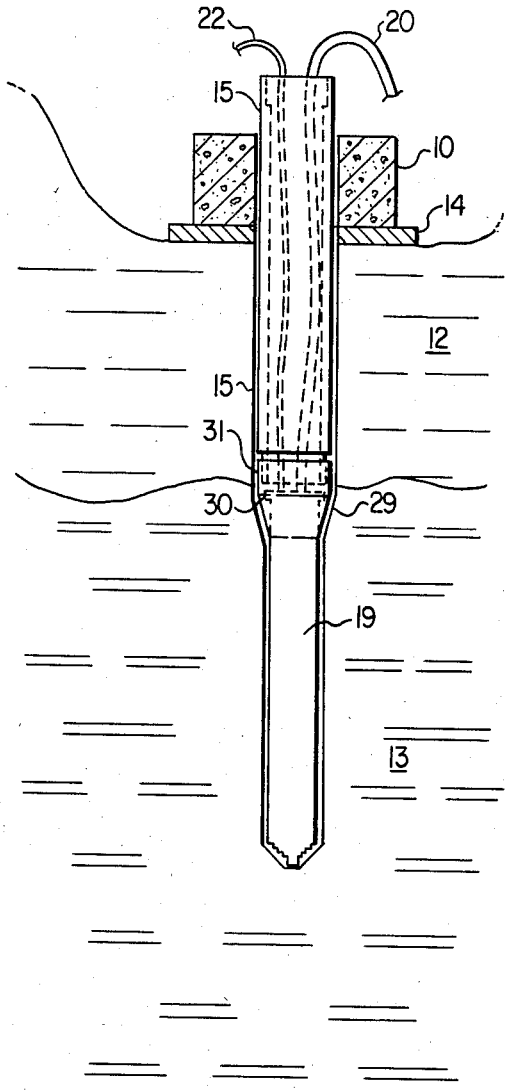
FIG. 2 is a diagrammatic and partially cross-sectioned view of a self-propelled mole drawing a first steel tube of larger diameter than the exterior diameter of the mole.
Figure 3:
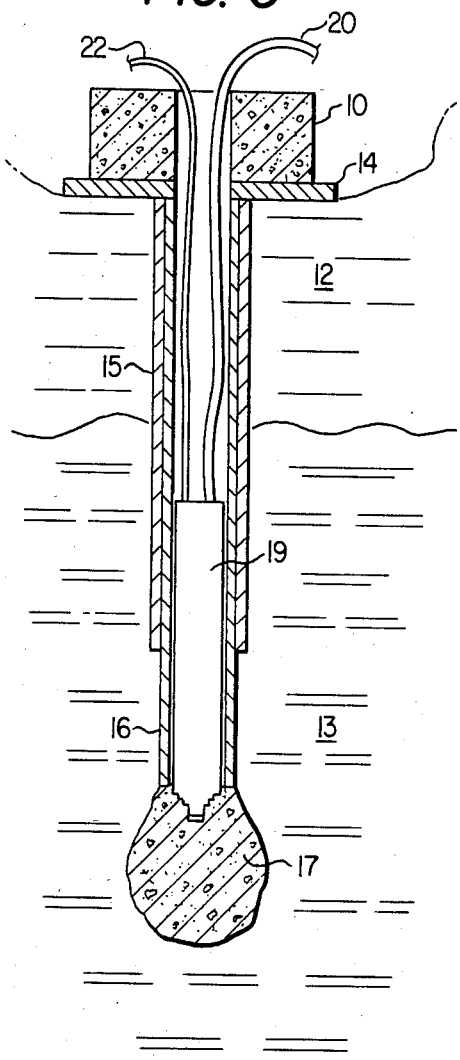
FIG. 3 is a diagrammatic and partially cross-sectioned views of a self-propelled mole forming a footing in situ by laterally displacing un-set concrete.

Each pile 11 is formed by the following steps illustrated in FIGS. 2 and 3:

(1) Forming a hole by allowing an elongate self-propelled soil displacing mole 19 to descend through the subsoil layers 12,13. A suitable mole is described in British Pat. No. 1,392,868 and U.S. Pat. Nos. 3,865,200; 3,891,036; and 3,970,157; and is commercially available under the Trade Mark GRUNDOMAT from the Patentee.

(2) The mole 19 draws down with itself a steel tube 15 of significantly larger internal diameter than the external diameter of the mole, whereby to line the hole. In one form the front end of the tube may be releasably attached to the mole. In another form the mole has a draw cable 22 attached to its rear end. The cable is threaded through the tube and secured to a cable clamp releasably attached to the rear end of the tube. The draw cable 22 and an air line 20 to the mole (which is pneumatically operated) are threaded through a length of pipe of internal diameter slightly larger than the outside diameter of the mole. A cable clamp is secured to the rear end of the pipe and the draw cable clamped thereto at a point such that, with a taunt cable, about one-half the length or rather less of the rearward portion of the mole is received within the pipe. The mole is then introduced to the location where a pile hole is required and operated to descend through the subsoil, thus also drawing the pipe down the hole.

At a suitable depth the cable clamp is released and the mole withdrawn by hauling it up through the bore of the tubular member, preferably by means of the same draw cable. The tubular member remains in the hole thereby preventing any inward collapse of the walls of the hole which may tend to occur in certain subsoil conditions, for example peaty or clay subsoils. An alternate method of drawing down a tubular member was previously described in my British Application GB No. 2 048 999A, and is illustrated in FIG. 2. The mole carries a tapered hole expander member 29 (schematically exaggerated in FIG. 2) preferably at its tail end. The arrangement is such that the mole carries the expander forward during formation of the hole, but the mole can be withdrawn backwardly through the expander, leaving the expander in the hole. This may be accomplished by mutually abutting flanges shown schematically at 30 or by a suitable form of connection detachable by operation of a remote control drag cable. The expander 29 has an internally threaded rear section 31 for connection to a tubular member 15.

The internal diameter of the expander and of the tubular member 15 is larger than the external diameter of the body of the mole. The rear end of the tubular member 32 may be internally threaded to permit successive similar tubular members to be joined end to end as the moled hole deepens. A plurality of the tubular members are threaded onto the air line 22 and control cable 22 of the mole before work commences. The successive tubular members are connected as the end of the preceding tubular member descends to adjacent the top surface of the slab, thereby permitting practice of the method of this invention in a site with limited headroom. When the hole is of sufficient depth the mole is withdrawn up within the bore of the expander 29.

(3) After the mole is withdrawn up through the bore of the tube, a second tube 16, e.g. of PVC or cardboard, is slidingly received down within the first tube 15.

(4) The hole within the interior of tubular member 16 is filled with concrete, 11.

(5) The mole 19 is allowed to descend within the filled hole before the concrete sets to produce an integral pile footing 17. The mole 19 is re-introduced, before the concrete 11 sets, and allowed again to work its way down the hole as shown in FIG. 3. This action displaces the concrete to produce a bulbous pile footing 17 and also displaces concrete 11 into the walls of the hole which in turn further laterally consolidates the subsoil around the hole to enhance the skin friction effect. This step also produces a slightly irregular outline for pile footing 17 due to the natural inhomogeneity of the subsoil further to enhance the skin friction effect.

(6) The mole is withdrawn.

(7) The hole is refilled with additional concrete 11, as illustrated in FIG. 1, and the concrete allowed to set to form an in situ cased pile with an integral footing, whereby to isolate the pile from frictional engagement with the subsoil 12 to mitigate any problem that may be caused by heave in the subsoil layer 12.

Any movement of soil 12 is isolated from the pile 11 and pile footing 17 by means of tubular member 15. As the unstable soil moves, tubular member 15 slides up and down along the exterior of tubular member 16. Both swelling upheaval and subsistence are isolated from the building footing 10. Thus a developer may build on clay which may swell, or backfill which may subside.

I claim:

1. A method of constructing a pile in situ through a region of unstable soil to rest on a region of stable soil, said method comprising the steps of:

(a) forming a hole through the unstable soil to a region of stable soil by allowing an elongate self-propelled soil displacing mole to descend to the stable soil, said mole drawing down with itself a first tubular member of internal diameter larger than the external diameter of the mole to line the hole;

(b) withdrawing the mole up through the bore of the first tubular member;

(c) inserting a second tubular member within the first tubular member, the second tubular member having an external diameter smaller than the internal diameter of the first tubular member and an internal diameter larger than the diameter of said mole;

(d) filling the hole within the second tubular member with concrete;

(e) inserting said mole into the filled hole before the concrete sets to produce a pile footing in said stable soil at the base of the second tubular member;

(f) withdrawing said mole;

(g) refilling the hole in said second tubular member with concrete and allowing the concrete to set to form an in situ double cased pile with an integral footing; and (h) completing steps (d) through (g) whereby the first tubular member may receive heave loads from the surrounding soil and move longitudinally along the axis of the pile without transfer of such loads to the second tubular member thereby isolating the pile from frictional engagement with the unstable soil.

2. The method according to claim 1 wherein the first and second tubular members extend over substantially the full length of the pile.

3. The method according to claim 1 wherein the first tubular member is of steel.

4. The method according to claim 1 wherein the second tubular member is of polyvinylchloride.

5. The method according to claim 3 wherein the second tubular member is of polyvinylchloride.

6. The method according to claim 1 wherein the second tubular method is cardboard.

7. The method according to claim 3 wherein the second tubular method is cardboard.

8. A method of constructing a pile in situ through a region of unstable soil to rest on a region of stable soil, said method comprising:

(a) forming a hole through said region of unstable soil to a region of stable soil by directing an elongate self-propelled soil displacing mole to descend downwardly through said region of unstable soil;

(b) lining a portion of the length of said hole with a first tubular member having an internal diameter significantly larger than the external diameter of the mole, said lining extending through said region of unstable soil leaving the hole at the bottom thereof unlined for a length of at least equal to half the length of said mole;

(c) withdrawing said mole through the bore of said first tubular member;

(d) lining said first tubular member with a second tubular member, said second tubular member having an outside diameter smaller than the inside diameter of said first tubular member and an inside diameter larger than the diameter of said mole, said second tubular member extending below the bottom end of said first tubular member and to said region of stable soil;

(e) filling said second tubular member with unset concrete and directing said mole downwardly through said unset concrete to force the concrete outwardly into an enlarged pile footing below said second tubular member, and then withdrawing said mole before said concrete sets; and (f) refilling said second tubular member with concrete to form an in situ doubled cased pile with an integral footing, said pile resting on stable soil and isolated from said unstable soil over at least a portion of its length by said first tubular member.

9. The method according to claim 8 wherein the first and second tubular members extend over substantially the full length of the pile.

10. The method according to claim 8 wherein the first tubular member is first formed of steel.

11. The method according to claim 8 wherein the second tubular member is first formed of polyvinylchloride.

12. The method according to claim 8 wherein said second tubular member is first formed of cardboard.

13. The method according to claim 8 wherein steps (e) and (f) are completed without expanding the second tubular member against the first tubular member whereby the first tubular member may receive heave loads from the surrounding soil and move longitudinally along the axis of the pile without transfer of such loads to the second tubular member thereby isolating the pile from frictional engagement with the unstable soil.

* * * * *

UNITED STATES PATENT AND TRADEMARK OFFICE

CERTIFICATE OF CORRECTION

PATENT NO. : 4,605,339

DATED : August 12, 1986

INVENTOR(S) : Roger A. Bullivant

It is certified that error appears in the above-identified patent and that said Letters Patent is hereby corrected as shown below:

In the title, add "IN" before "SITU".

In the Abstract, line 1, change "a" to --an--.

Column 2, line 55, change "views" to --view--.

Column 3, line 65, change "air line 22" to --air line 20--.

Column 4, line 29, change "soil" to --subsoil--.

Signed and Sealed this

Ninth Day of December, 1986

*Attest:*

DONALD J. QUIGG

*Attesting Officer* *Commissioner of Patents and Trademarks*